US008469732B2

(12) United States Patent
Sen et al.

(10) Patent No.: US 8,469,732 B2
(45) Date of Patent: Jun. 25, 2013

(54) LATCHING MECHANISM FOR A CONNECTOR

(75) Inventors: Tang Chin Sen, Perak (MY); Kee Cheah Chan, Malaysia (MY); Quah Tee Hoh, Perak (MY)

(73) Assignee: Motorola Solutions, Inc., Schaumburg, IL (US)

( * ) Notice: Subject to any disclaimer, the term of this patent is extended or adjusted under 35 U.S.C. 154(b) by 106 days.

(21) Appl. No.: 13/210,502

(22) Filed: Aug. 16, 2011

(65) Prior Publication Data

US 2013/0045618 A1 Feb. 21, 2013

(51) Int. Cl.
*H01R 13/625* (2006.01)

(52) U.S. Cl.
USPC ..... 439/347

(58) Field of Classification Search
USPC ..... 439/347, 345, 372, 373
See application file for complete search history.

(56) References Cited

U.S. PATENT DOCUMENTS

| | | | | | |
|---|---|---|---|---|---|
| 3,953,797 | A * | 4/1976 | Bally Berard et al. | 324/537 |
| 4,385,791 | A * | 5/1983 | Lovrenich | 439/83 |
| 4,412,714 | A * | 11/1983 | Morningstar et al. | 439/352 |
| 4,460,235 | A * | 7/1984 | Gelin | 439/629 |
| 4,711,507 | A * | 12/1987 | Noorily | 439/292 |
| 4,871,323 | A * | 10/1989 | Ohsumi | 439/188 |
| 4,884,981 | A * | 12/1989 | Chandler et al. | 439/607.41 |
| 4,959,021 | A * | 9/1990 | Byrne | 439/310 |
| 5,637,009 | A * | 6/1997 | Tsuji et al. | 439/347 |
| 5,823,814 | A * | 10/1998 | Alwine | 439/352 |
| 5,895,729 | A * | 4/1999 | Phelps et al. | 429/97 |
| 6,091,147 | A * | 7/2000 | Furuyama | 257/730 |
| 6,155,849 | A * | 12/2000 | Kodama et al. | 439/157 |
| 6,155,862 | A * | 12/2000 | Chiu et al. | 439/347 |
| 6,171,138 | B1 * | 1/2001 | Lefebvre et al. | 439/500 |
| 6,264,482 | B1 * | 7/2001 | Kodama et al. | 439/122 |
| 6,361,356 | B1 * | 3/2002 | Heberlein et al. | 439/489 |
| 6,375,486 | B1 * | 4/2002 | Yu | 439/347 |
| 6,491,542 | B1 * | 12/2002 | Zerebilov | 439/489 |
| 6,625,425 | B1 | 9/2003 | Hughes et al. | |
| 6,729,897 | B2 * | 5/2004 | Lai | 439/347 |
| 6,875,041 | B1 * | 4/2005 | Chang et al. | 439/347 |
| 6,884,100 | B1 * | 4/2005 | Hsiao | 439/327 |

(Continued)

FOREIGN PATENT DOCUMENTS

EP 2182538 A1 * 5/2010

OTHER PUBLICATIONS

International Search Report and Written Opinion for International Patent Application No. PCT/US2012/048835 issued on Oct. 11, 2012.

*Primary Examiner* — Briggitte R Hammond
*Assistant Examiner* — Vladimir Imas
(74) *Attorney, Agent, or Firm* — Barbara R. Doutre

(57) ABSTRACT

A connector (100) is formed of a housing having a tab (112), a cover (104) for sliding over a section of the housing and a latch (106) slideably coupled to the cover. The connector (100) is attached to a device by aligning the tab (112) of the housing (102) into the device, sliding the cover (104) inward towards the housing thereby engaging the cover and housing to the device, and pressing the latch (106) downward to lock the connector to the device. The connector (100) is detached from the device by pulling the latch (106) upward to unlock the connector from the device, sliding the cover (104) outward to disengage the cover from the device, and releasing the tab (112).

24 Claims, 7 Drawing Sheets

U.S. PATENT DOCUMENTS

| | | | | |
|---|---|---|---|---|
| 6,902,419 | B2 * | 6/2005 | Conway et al. | 439/347 |
| 6,948,952 | B2 * | 9/2005 | Hubbard et al. | 439/136 |
| 7,297,014 | B1 * | 11/2007 | Stowers et al. | 439/372 |
| 7,410,371 | B2 | 8/2008 | Shabtai et al. | |
| 7,484,990 | B1 * | 2/2009 | Lee et al. | 439/369 |
| 7,510,345 | B2 * | 3/2009 | Kosh et al. | 403/330 |
| 7,572,138 | B1 | 8/2009 | Wu | |
| 7,647,079 | B2 * | 1/2010 | Zuo et al. | 455/575.1 |
| 7,771,225 | B1 * | 8/2010 | Wu | 439/352 |
| 7,780,047 | B2 * | 8/2010 | Chen et al. | 224/218 |
| 7,811,115 | B1 * | 10/2010 | Tyler | 439/352 |
| 7,813,112 | B2 * | 10/2010 | Ge et al. | 361/679.01 |
| 7,909,646 | B2 * | 3/2011 | Feldman et al. | 439/579 |
| 8,014,135 | B2 * | 9/2011 | Yu | 361/679.01 |
| 8,113,864 | B2 * | 2/2012 | Chiang | 439/347 |
| 8,163,414 | B2 * | 4/2012 | Wan et al. | 429/96 |
| 8,187,033 | B2 * | 5/2012 | Feldman et al. | 439/579 |
| 8,205,310 | B2 * | 6/2012 | Shi et al. | 24/637 |
| 2007/0026297 | A1 * | 2/2007 | Qin et al. | 429/97 |
| 2007/0122693 | A1 * | 5/2007 | Qin et al. | 429/97 |
| 2007/0296225 | A1 | 12/2007 | Ashton et al. | |

* cited by examiner

LATCHING MECHANISM FOR A CONNECTOR

FIELD OF THE INVENTION

The present invention relates generally to connectors and more particularly to a latching mechanism for a connector to interface with a communication device.

BACKGROUND

Accessory connectors are often used in conjunction with portable communication devices, such as two-way radios and the like. Many of today's accessory connectors utilize a screw-type attachment mechanism in which a screw and insert-nut are used for mounting and retaining the accessory to the device. The user interface on such connectors may vary from individual to individual in terms of the amount of torque being applied to the screw and the time needed to screw and unscrew the connector to and from the device. Depending on the environment, the screw-type connector may also face issues with corrosion and susceptibility to electrostatic discharge (ESD).

The tactile feedback provided by an accessory connector is particularly important for portable communication devices operating within a public safety environment. For example, in public safety environments involving fire rescue, paramedic and/or law enforcement, a handheld radio may be operated by a user wearing heavy gloves, working in an area with little or no illumination, or other environmental or physical conditions that necessitate a simple, fast, easy to use connector interface. The user interface should also be consistent, reliable and robust.

Accordingly, an improved connector is highly desirable.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 2:
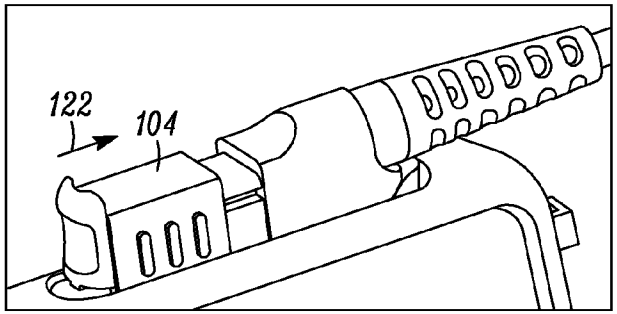
FIGS. 1-4 show various stages of a connector being attached to a housing in accordance with the various embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in apparatus components related to a connector for a communication device. Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the elements.

Figure 1:
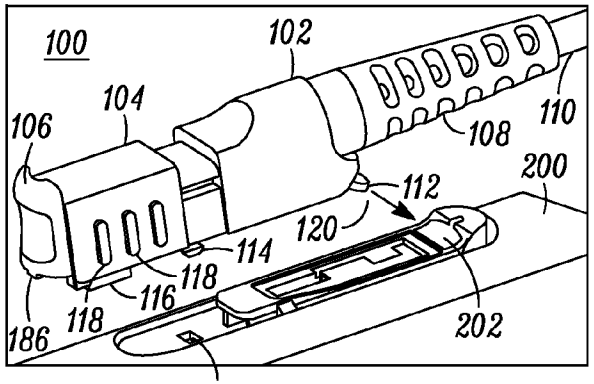

FIG. 1 is a connector 100 formed in accordance with the various embodiments. Connector 100 can be for example, an accessory connector for coupling a remote accessory, such as an earpiece, remote speaker-microphone, remote data device, wireless dongle or the like, to an electronic device 200, such as a portable radio or other electronic device. Connector 100 comprises a mechanism for latching and unlatching the connector to and from the electronic device 200 in accordance with the various embodiments. FIGS. 1-4 show various stages of the connector 100 being engaged to the device 200, and FIGS. 5-8 show various stages of the connector being disengaged from the device in accordance with the various embodiments.

The connector 100 comprises a housing 102, a cover 104, and a latch 106 formed in accordance with the various embodiments. A strain relief 108 and cable 110 known in the art can be used to interconnect the connector 100 to a remote accessory. While shown with the strain relief 108 and cable 110, these elements are not be necessary for accessories embodied entirely within the connector 100 and mounted directly to the electronic device 200. The housing 102, the cover 104, and the latch 106 provide the mechanism for engaging and disengaging the connector 100 to and from the electronic device 200 in accordance with the various embodiments. The housing 102, the cover 104 and the latch 106 are each formed of unitarily molded piece parts inter-operably coupled together, in a manner to be described herein, without the use of springs or screws. Various plastics, resins or other materials suitable for injection-molding processing may be used to form the housing 102, cover 104 and latch 106. An electrical contact interface (shown later in FIG. 20) is coupled to a bottom surface of the housing 102 for mating with corresponding contacts of electronic device 200.

In accordance with the various embodiments, the cover 104 of connector 100 provides inward/outward motion relative to the housing 102, and the latch 106 provides upward/downward motion relative to the cover 104 and the housing. The inward/outward motion of the cover 104 is perpendicular to the upward/down motion of the latch 106.

In accordance with the various embodiments, the housing 102 includes a tab 112 which is slid 120 into a corresponding first aperture 202 of the device 200. Tab 112 extends from the housing to provide alignment of the connector 100 relative to the device 200 and may be an angled tab. The connector 100 may further comprise first and second side guide inserts 114 to further facilitate alignment of the housing 102 to the device 200. The connector 100 may further comprise engagement feature 116 for further securing the cover 104 to the device 200. The connector 100 may further comprise a plurality of integrally molded side grips 118 to facilitate the inward/outward action of the cover 104.

The unitarily molded piece parts of housing 102, cover 104 and latch 106 are contoured to provide an overall user friendly form factor. The connector 100 provides connection to the device 200 in three easy steps: insert tab 112, slide cover 104 inward, and press down latch 106. Likewise detachment is just as simple: pull up latch 106, slide cover 104 outward, and release tab 112. Likewise detachment of connector 100 from the device is just as simple: pull-up latch, pull down cover, and release tab. The housing, 102, cover 104 and latch 106 provide an overall slideable form factor for easy engagement and disengagement of the connector 100. This slideable form factor provides a highly user friendly interface which is consistent, easy to use and robust.

Figure 4:
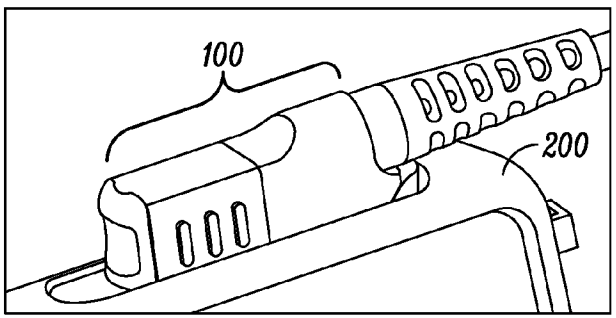
Figure 3:
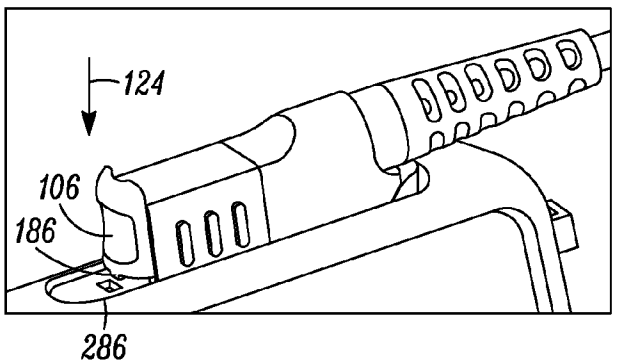

In operation, once the tab 112 of housing 102 is slid into device aperture 202, as was shown in FIG. 1, the cover 104 is then slid inward 122, as shown in FIG. 2, towards the housing 102 thereby engaging the cover 104 and housing 102 to the device 200. The latch 106 is then slid/pressed downward 124, as shown in FIG. 3, such that bottom catch 186 slides into a second corresponding aperture 286 of the device 200, thereby locking the connector 100 to the device 200. FIG. 4 shows connector 100 locked to device 200.

Figure 6:
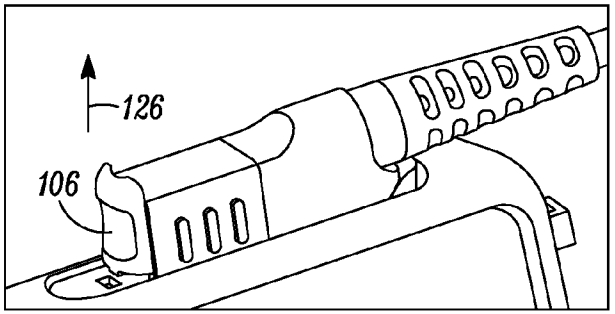
FIGS. 5-8 show the accessory connector being detached from the housing in accordance with the various embodiments.
Figure 8:
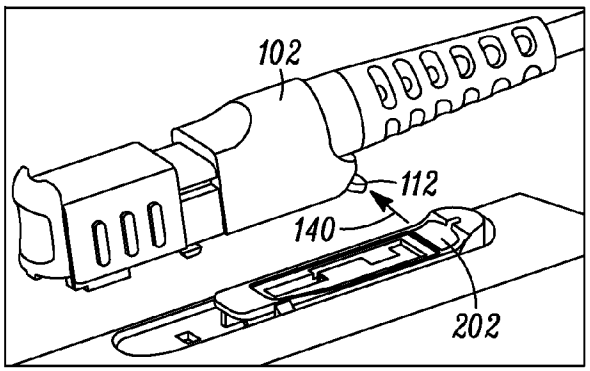
Figure 5:
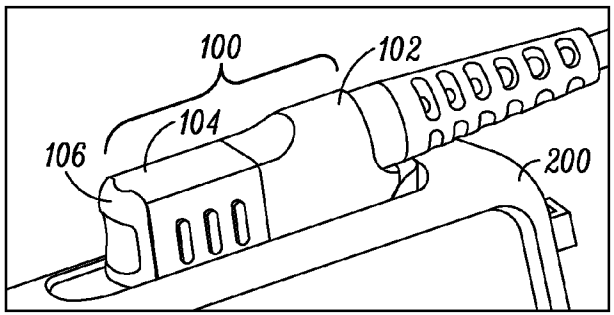
Figure 7:
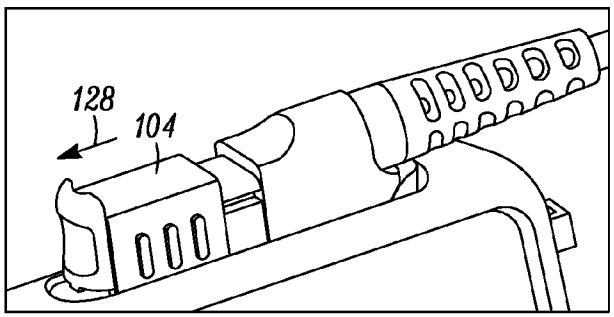

Referring now to FIG. 5, connector 100 is shown as in FIG. 4, in the closed/locked position, prior to detachment. The connector 100 is detached from the device 200 by pulling the latch 106 in an upward direction 126 to unlock the connector from the device, as seen in FIG. 6. The cover 104 is slid in an outward direction 128 to disengage the cover 104 from the device 200, as shown in FIG. 7, thereby allowing the tab 112 of housing 102 to be released 140 from the device, as shown in FIG. 8.

Figure 9:
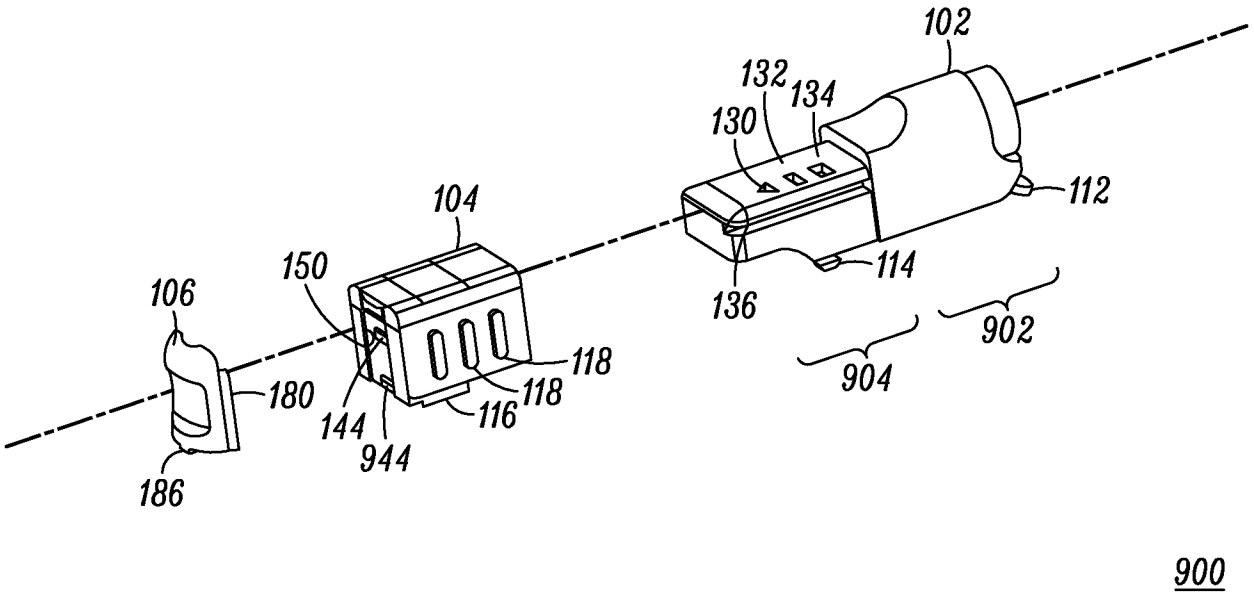
FIG. 9 is an exploded view of the connector in accordance with the various embodiments.

FIG. 9 shows an exploded view 900 of the connector 100 in accordance with the various embodiments. The connector 100 is formed of three connector portions, first portion being housing 102, second portion being cover 104 and third portion being latch 106.

In this exploded view 900, housing 102 is shown having a first section 902 which provides a sloped exterior upper surface, and a second section 904 having a flat upper surface for interior coupling to the cover 104. The upper flat surface of the second section 904 comprises top catch 130, first bump 132, and second bump 134. Guide rails 136 are formed along first and second side surfaces of the second section 904 (which will align with corresponding side rails of the cover 104—to be shown and described in later views). Side inserts 114 are located at the bottom of the side surfaces of second section 904 to couple to a device. Additional details pertaining to the housing 102 will be described in subsequent views.

Cover 104 is designed in a manner to be described herein to slide back and forth along the second section of housing 102. Cover 104 comprises front cover bump 144 which is located on a front surface of the cover 104. The front surface of cover 104 further comprises a slot 150 within which to receive the latch 106. Cover 104 may further comprise engagement feature 116 located along the bottom/front surface for coupling to a corresponding feature within the device. Side grips 118 may also be used for additional tactile feedback for a user to grab the cover for sliding back and forth. The cover 104 can further comprise a hard-stop 944 below the front cover bump 144 at the base of the front cover. Other portions of the cover will be described in subsequent views.

Latch 106 comprises a flange 180 which is insertable into slot 150 of cover 104. Latch 106 further comprises bottom catch 186 located on a bottom surface for locking into a device. Other positions of the latch will be described in subsequent views. Latch 106 is shown with a scooped front surface for improved tactile feedback.

These three portions are easily assembled without the use of a screw to provide an overall connector 100 with improved user interface and tactile feedback. When completely assembled, the inward/outward motion of the cover 104 being perpendicular to the upward/downward motion of the latch 106 facilitates alignment, attachment and detachment of the connector 100 to and from a device. The slopped housing section 902, side grips 118 of cover 104, and scooped out portion of the latch 106 provide additional tactile feedback that intuitively leads the user to feel the three sections and the interoperability of each. The operation of the internal elements is described in subsequent views.

Figure 10:
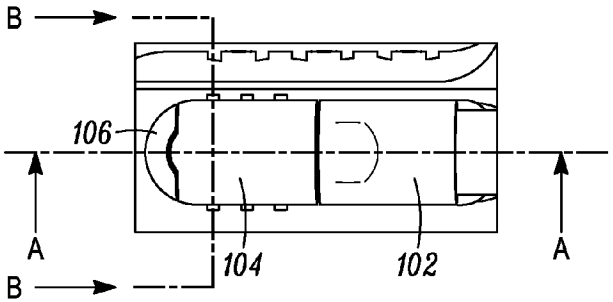
FIG. 10 is a top view of the connector coupled to a device labeled with various cross-section labels that align with corresponding cross-sectional views shown in FIGS. 11-13 in accordance with the various embodiments.

FIG. 10 shows a top view of the connector 100 having housing 102, cover 104 and latch 106 in a closed, locked position. This view is labeled with cross-sectional cuts AA and BB to align with corresponding cross-sectional views shown in FIGS. 11-13.

Figure 11:
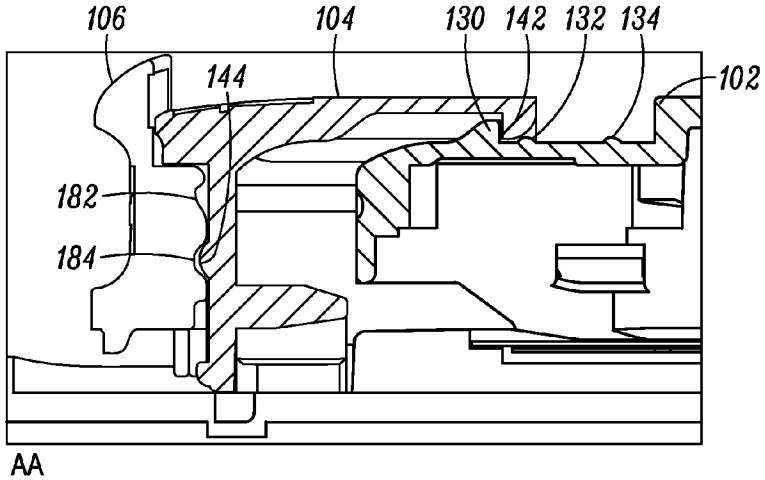
FIG. 11 is a side cross sectional view of the connector showing an open position cover and unlocked latch in accordance with the various embodiments.

FIG. 11 is a side cross-sectional view (AA) of the connector 100 with cover 104 coupled to housing 102 in an open position, and latch 106 coupled to cover 104 in an unlocked position in accordance with the various embodiments. In this view, the top catch 130, first bump 132, and second bump 134, for securing the cover 104 to the housing 102 are shown. The first bump 132 provides a detent to restrain the cover 104 in response to the cover being slid outward to a fully open position. The second bump 134 provides a second detent to restrain the cover in response to the cover being slid inward to a full closed position, as seen in FIG. 12.

As further shown in FIG. 11, the cover 104 further comprises a back hook 142. The back hook 142 engages with the top catch 130 and the first bump 132 of the housing 102 when the cover 104 is pulled completely outward, thereby securing the cover to the housing when the cover is in the fully open position.

As also shown in FIG. 11, latch 106 further comprises first and second recesses 182, 184 for aligning with front cover bump 144 depending on whether the latch is in a locked or unlocked position. In this view, the latch 106 is pulled up in an unlocked position and secured by the latch's second recess 184 aligning with front cover bump 144.

Figure 12:
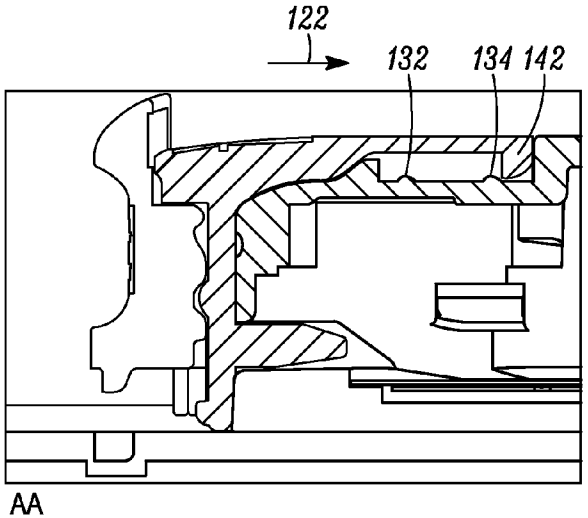
FIG. 12 is a side cross sectional view of the connector showing a closed cover position and unlocked latch in accordance with the various embodiments.

FIG. 12 is another cross-sectional view (AA) of connector 100 with the cover 104 coupled to housing 102 in a closed position. As the cover 104 moves inward 122, the back hook 142 travels over first and second bumps 132 and 134, and the detent provided by second bump 134 secures the cover to the housing 102 when the cover is in the fully closed position.

Figure 13:
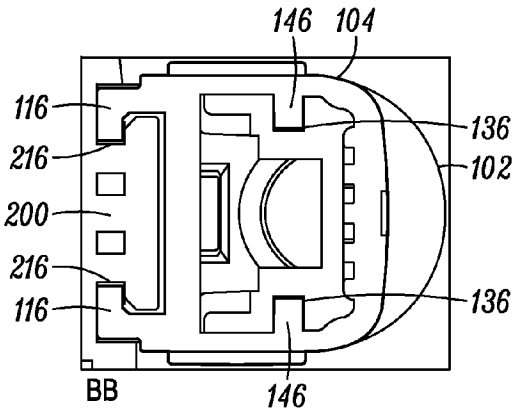
FIG. 13 is a front cross sectional view (without the latch) showing side rails of the cover engaged within guide rails of the housing in accordance with the various embodiments.

FIG. 13 is a front cross-sectional view (BB) of connector 100 (without the latch) with the cover 104 in a closed position. As seen in FIG. 13, the cover 104 further comprises side rails 146 integrally formed on first and second interior side surfaces to correspond and align with guide rails 136 of housing 102. The side rails 146 guide the cover 104 as the cover is slid outward and inward along the guide rails 136 of the housing 102. The engagement feature 116 of cover 104 is seated within corresponding feature 216 of the device 200 when the cover is slid to the fully closed position.

Figure 14:
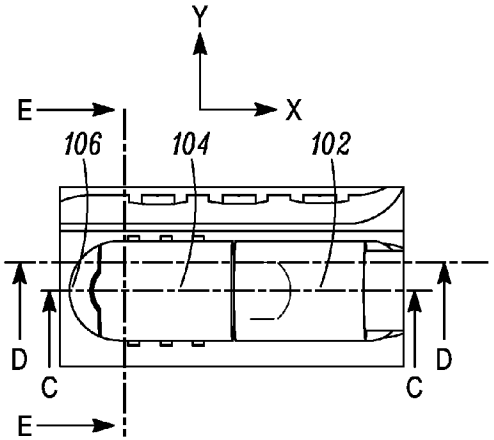
FIG. 14 is a top view of the connector coupled to a device labeled with various cross-section labels that align with corresponding cross-sectional views shown in FIGS. 15-19 in accordance with the various embodiments.

FIG. 14 shows a top view of the connector 100 having housing 102, cover 104 and latch 106 coupled to a device. FIG. 14 is labeled with various axial cuts CC, DD, and EE to align with corresponding cross-sectional views in FIG. 15-19.

Figure 15:
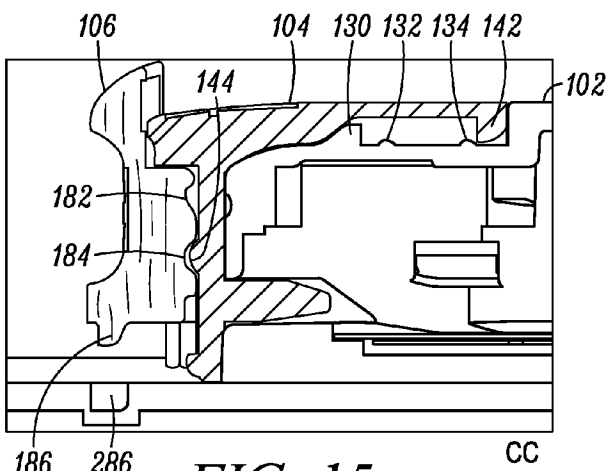
FIG. 15 is a side cross sectional view of the connector with the cover in the closed position and the latch in an unlocked position in accordance with the various embodiments.

FIG. 15 shows the cover 104 in the fully closed position with back hook 142 restrained by second bump 134. In this view, taken across axial cut CC, the latch 106 is still pulled up and secured by the latch's second recess 184 alignment with front cover bump 144.

Figure 16:
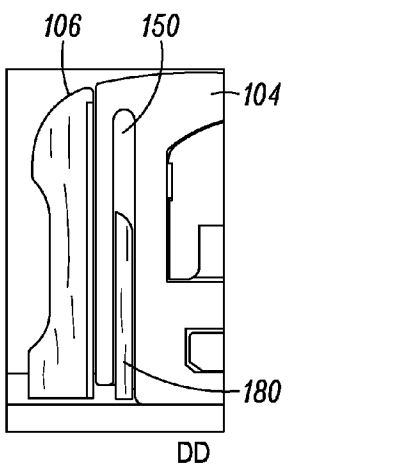
FIG. 16 is a side cross sectional view of the connector with the latch engaged to the front cover slot in accordance with the various embodiments.

FIG. 16 shows a second cross sectional view of the latch 106 and front cover 104 taken across the DD axial cut. This view shows the front cover slot 150 engaging the latch 106 via flange 180. The flange 180 slides upward and downward within slot 150 as the latch is moved upward and downward.

Figure 17:
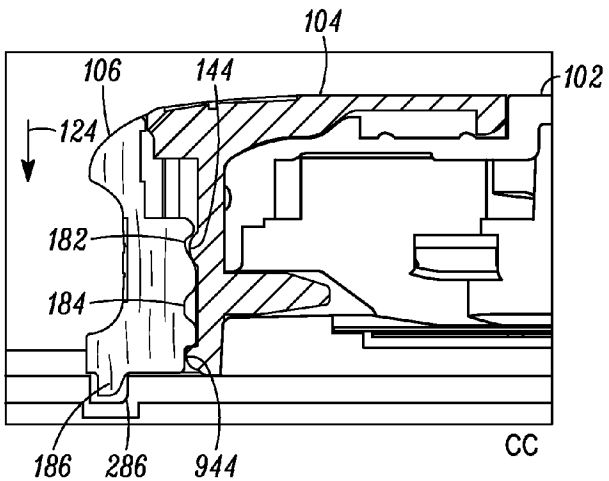
FIGS. 17 is a side cross sectional view of the connector with the latch in a locked position and the cover in a closed position in accordance with the various embodiments.

FIG. 17 is a side cross sectional view of the connector 100 taken across cut CC, showing the latch 106 in a locked position in accordance with the various embodiments. As seen in this view the first recess 182 of latch 106 is aligned with the front cover bump 144 as the latch is pressed downward 124 for a closed latch position. The bottom catch 186 of latch 106 is secured within the second corresponding aperture 286 of the device as the latch is pressed in the downward position. Additional downward movement may be restricted by hard-stop 944 of cover 104.

Figure 18:
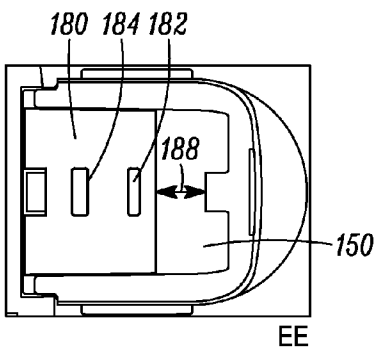
FIG. 18 is cut-away view showing the flange of the latch in accordance with the various embodiments.

FIG. 18 shows a cross sectional view of the latch 106 in a closed latch position taken across the EE axial cut. This view shows the first and second recesses 182, 184 located on the flange 180 of latch 106. The amount of travel 188 of the flange 180 within slot 150 is also indicated.

Figure 19:
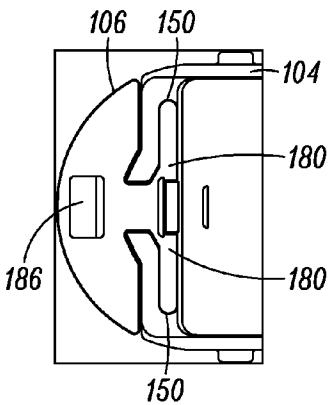
FIG. 19 is a bottom view of the latch with its flange engaged within the cover in accordance with the various embodiments.

FIG. 19 shows a bottom view of the latch 106 with its flange 180 engaged within the cover 104 (without the device 200). This view shows the flange 180 being retained within front cover slot 150 of cover 104. The flange 180 of the latch 106 flexes when pushed upward or downward such that the first and second recesses 182, 184 move over the front cover bump 144. This further ensures the locking action for the bottom catch 186 when the latch is pushed downward.

To summarize operation, the connector 100 is attached to a device 200 by inserting the tab 112 of housing 102 into a first aperture 202 of the device, sliding the cover 104 inward such that the side rails 146 of the cover slide along the guide rails 136 of the housing 102. The cover 104 slides over the first and second bumps 132, 134 of the housing 102 thereby engaging the cover 104 in a closed position relative to housing 102. The latch 106 is pressed downward such that the first recess 182 of the latch 106 aligns with the front cover bump 144 thereby locking the bottom catch 186 to a second corresponding aperture 286 of the device.

The connector 100 is detached from the device 200 by pulling the latch 106 upward to unlock the bottom catch 186 from the second corresponding aperture 286 of the device 200, such that the second recess 184 of the latch 106 aligns with the front cover bump 144. The cover 104 is slid outward such that the side rails 146 of the cover 104 slide along the guide rails 136 of the housing 102. The cover 104 slides over the second and first bumps 134, 132 of the housing 102 until the back hook 142 of the cover 104 hits the top catch 130 of the housing 102 thereby disengaging the cover 104 from the device and releasing the tab 112 of the housing from the first aperture 202 of the device 200.

Figure 20:
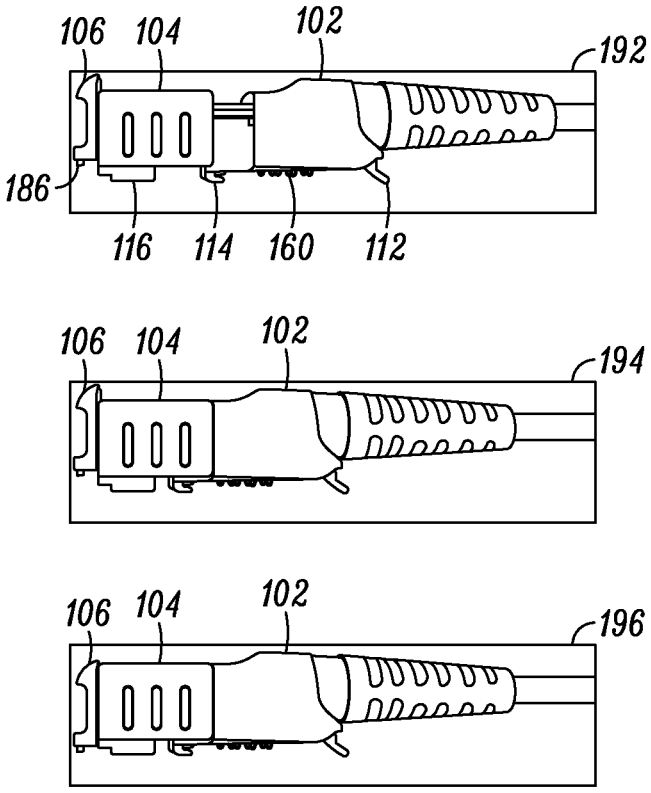
FIG. 20 shows the connector formed in accordance with the various embodiments in three positions.

FIG. 20 shows the connector 100 formed in accordance with the various embodiments in three positions. First position 192 shows the connector 100 with cover 104 slid outward from the housing 102, and the latch 106 pulled upward. Second position 194 shows the connector 100 with the cover 104 slid inward and the latch 106 pulled upward. Third position 196 shows the connector 100 with the cover 104 slid inward and the latch 106 pressed downward. Exterior alignment and contact features such as housing tab 112, electrical contacts 160, side inserts 114, engagement feature 116, and bottom catch 186 are also visible in these views. Electrical contacts 160 may be coupled to an interior printed circuit board or flex with appropriate electrical components in accordance with the type of accessory being embodied within connector 100 (for example a wireless dongle) or coupled thereto (for example wired remote speaker-microphone).

Figure 21:
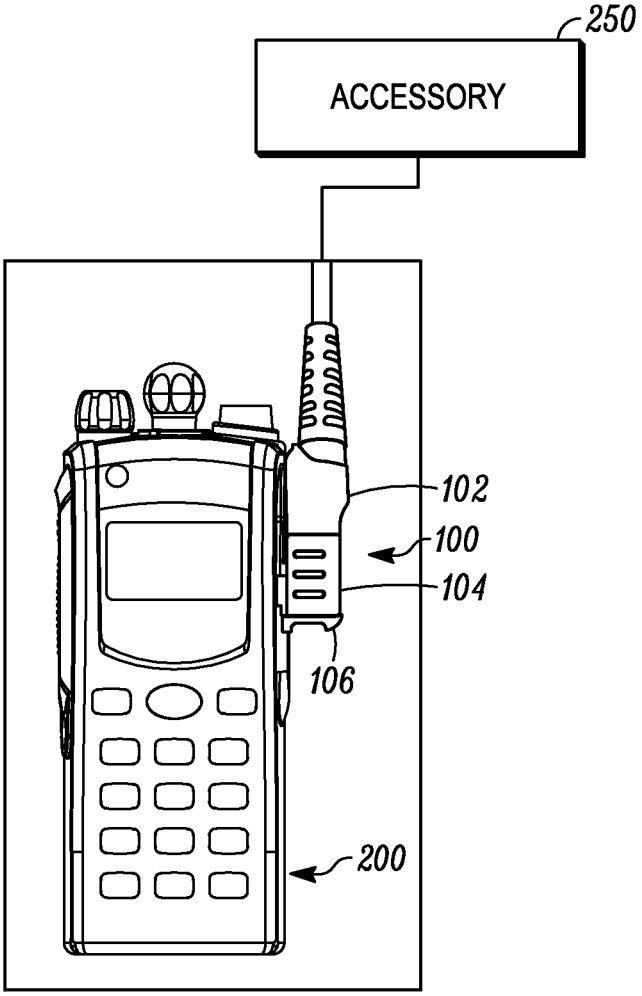
FIG. 21 is the connector formed in accordance with the various embodiments coupling an accessory to a communication device 200.

Referring to FIG. 21, there is shown connector 100 formed in accordance with the various embodiments coupling an accessory 250 to communication device 200, such as a portable handheld radio. Connector 100 can be for example, an accessory connector for coupling a remote accessory, such as an earpiece, remote speaker-microphone, remote data device, or the like to the portable radio. The strain relief 108 and cable 110 known in the art interconnect the connector 100 to the remote accessory. In an embodiment in which connector 100 embodies the accessory itself, such as a wireless dongle, no strain relief or cable are needed.

In accordance with the various embodiments the interface mechanism of the connector 100 couples to the radio 200 in three easy steps comprising: inserting the tab 112 of housing 102 into the radio; sliding the cover 104 inward to engage the cover and housing 102 with the radio; followed by locking the connector by applying a downward motion to the latch 106. To detach the connector 100 from radio 200, the above process is repeated in the opposite order. In this case, the latch 106 is pulled upward and then the cover 104 is slid outward until the cover's top catch 142 is located by the first bump 132 and the bottom engagement of tab 112 is released.

Accordingly, there has been provided a connector which can be applied to any product that requires robust, reliable and quick release engagement. The tactile feedback provided by the connector, formed in accordance with the various embodiments, facilitates the attachment and detachment of the connector to and from an electronic device. The connector is ideal for operation with devices used within the public safety environments, such as fire rescue and law enforcement to name a few. For example, a user wearing heavy gloves, or working in an area with little or no illumination, or other environmental condition, can rely on the connector for a simple, consistent, fast, easy to use connector interface which is reliable and robust. This inexpensive connector has been implemented without a screw or nut thus reducing cost. The elimination of the screw and nut-insert eliminates issues with corrosion and electrostatic discharge (ESD), thereby further ensuring superior robustness and reliability.

While the various embodiments have been described in terms of an accessory connector for a portable communication device, it should be appreciated that connector can be used in conjunction with any electronic device requiring an electronic interface to external features. While particularly advantageous for public safety type applications, involving the interconnect of an accessory to a radio, the connector may also be applied to other applications, such as an interface between a battery and a radio, an interface between a mobile phone and a vehicular adapter to name a few. The connector formed in accordance with the various embodiments thus provides an improved means of attachment with an easy-to-use attachment/release interface for a variety of electronic devices and applications.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. A connector, comprising:
a housing having a tab extending therefrom;
a cover slideably coupled to the housing;
a latch slideably coupled to the cover; and
wherein the housing comprises:
a top catch for securing the cover to the housing;
a first bump providing a detent to restrain the cover in response to the cover being slid outward to a fully open position;
a second bump providing a second detent to restrain the cover in response to the cover being slid inward to a full closed position; and
guide rails for guiding the cover as the cover is slid outward and inward.

2. The connector of claim 1, wherein the tab aligns the connector, the cover engages and disengages the connector, and the latch locks and unlocks the connector.

3. The connector of claim 2, wherein the housing, the cover and the latch are each unitarily molded piece parts.

4. The connector of claim 2, wherein the unitarily molded piece parts couple together without the use of springs or screws.

5. The connector of claim 2, wherein the cover provides inward/outward motion relative to the housing, and the latch provides upward/downward motion relative to the cover and housing.

6. The connector of claim 5, wherein the inward/outward motion of the cover is perpendicular to the upward/down motion of the latch.

7. The connector of claim 1, wherein the connector is attached to a device by inserting the tab of the housing into the device, sliding the cover inward towards the housing thereby engaging the cover and housing to the device, and pressing the latch downward to lock the connector to the device.

8. The connector of claim 7, wherein the connector is detached from the device by pulling the latch upward to unlock the connector from the device, sliding the cover outward to disengage from the device, and releasing the tab from the device.

9. The connector of claim 8, further comprising:
an electrical contact interface coupled to a bottom surface of the housing.

10. The connector of claim 8, further comprising:
a strain relief coupled to the housing.

11. The connector of claim 8, wherein the cover further comprises:
first and second side guide inserts to facilitate alignment of the housing to the device.

12. The connector of claim 8, wherein the tab of the housing is an angled tab.

13. he connector of claim 8, wherein the cover further comprises a plurality of integrally molded side grips.

14. The connector of claim 1, wherein the cover comprises:
side rails for aligning within the guide rails of the housing;
a front cover slot for engaging the latch;
a back hook; and
a front cover bump.

15. The connector of claim 14, wherein the latch comprises:
a flange engaged within the front cover slot; and
first and second recesses for aligning with the front cover bump as the latch is pulled upward and pressed downward for open and closed latch positions respectively; and a bottom catch.

16. The connector of claim 15, wherein the connector is attached to a device by inserting the tab into a first aperture of the device, sliding the cover inward such that the side rails of the cover slide along the guide rails of the housing and over the first and second bumps of the housing thereby engaging the cover in a closed position relative to the device, and pressing the latch downward such that the second recess of the latch aligns with the front cover bump thereby locking the bottom catch to a second aperture of the device.

17. The connector of claim 16, wherein the connector is detached from the device by pulling the latch upward to unlock the bottom catch of the housing from the second aperture of the device, the second recess of the latch aligning with the front cover bump, sliding the cover outward such that the side rails of the cover slide along the guide rails of the housing, the cover sliding over the first and second bumps of the housing until the back hook of the cover hits the top catch of the housing thereby disengaging the cover from the device, and releasing the tab of the housing from the first aperture of the device.

18. The connector of claim 17, wherein a flange of the latch flexes to allow the first and second recesses to move across the front cover bump.

19. A connector, comprising:
a housing having first and second portions;

a cover slideably coupled to the second portion of the housing, the cover providing open and closed connector positions, a latch slide ably slideably coupled to the cover, the latch providing locked and unlocked connector positions; and the locked connector position being provided when the cover is slid to a closed position relative to the housing, and the latch is slid to a downward position relative to the cover;

the unlocked connector position being provided when the cover is slid to an open position relative to the housing, and the latch is slid to an upward position relative to the cover; and the housing comprising:

a first bump providing a detent to restrain the cover in response to the cover being slid to the open position, and a second bump providing a second detent to restrain the cover in response to the cover being slid to the closed position.

20. The connector of claim 19, wherein the connector operates as an accessory connector for an electronic device, wherein the accessory connector interfaces to a remote accessory, or the accessory connector operates as the remote accessory itself coupled directly to the electronic device.

21. The connector of claim 19, wherein the housing further comprises:

a top catch for securing the cover to the housing; and guide rails for guiding the cover as the cover is slid to the open and closed positions.

22. A connector, comprising:

a housing;

a cover slideably coupled inwardly and outwardly to the housing, the cover having a front cover bump and a hard-stop;

a latch slideably coupled upwardly and downwardly to the cover, the latch comprising recesses for sliding over the front cover bump and hardstop.

23. The connector of claim 22, wherein the latch comprises a flange providing flexiblity to allow the recesses of the latch to move across the front cover bump.

24. The connector of claim 22, wherein the latch has a scooped front surface for tactile feedback.

* * * * *